US011987972B2

(12) United States Patent
Pryor

(10) Patent No.: US 11,987,972 B2
(45) **Date of Patent: *May 21, 2024**

(54) MOMENT FRAME FOR A SLOPED ROOF CONSTRUCTION

(71) Applicant: Simpson Strong-Tie Company Inc., Pleasanton, CA (US)

(72) Inventor: Steven E. Pryor, Dublin, CA (US)

(73) Assignee: Simpson Strong-Tie Company Inc., Pleasanton, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/674,532

(22) Filed: Feb. 17, 2022

(65) Prior Publication Data

US 2022/0259844 A1 Aug. 18, 2022

Related U.S. Application Data

(60) Provisional application No. 63/150,460, filed on Feb. 17, 2021.

(51) Int. Cl.
*E04B 1/24* (2006.01)

(52) U.S. Cl.
CPC .... *E04B 1/2403* (2013.01); *E04B 2001/2415* (2013.01); *E04B 2001/2418* (2013.01); *E04B 2001/2451* (2013.01); *E04B 2001/249* (2013.01)

(58) Field of Classification Search
CPC ..... E04B 1/2403; E04B 2001/2415; E04B 2001/2418; E04B 2001/2451; E04B 2001/249; E04B 2001/2442; E04B 2001/2448; E04B 2001/2487; E04C 3/11; E04C 3/32; E04C 3/40; E04C 2003/0452
See application file for complete search history.

(56) References Cited

U.S. PATENT DOCUMENTS 4,074,947 A * 2/1978 Matake ..... F16B 9/052 403/231
4,696,137 A * 9/1987 Schleich ..... E04C 3/34 52/251
6,474,902 B1 * 11/2002 Beauvoir ..... F16B 9/058 403/403
6,739,099 B2 * 5/2004 Takeuchi ..... E04B 1/2403 52/289
7,497,054 B2 * 3/2009 Takeuchi ..... E04C 3/04 403/403

(Continued)

FOREIGN PATENT DOCUMENTS

DE 202008012407 3/2009
FR 2228920 12/1974

OTHER PUBLICATIONS

International Search Report and Written Opinion dated May 31, 2022 in International Patent Application No. PCT/US2022/016826.

(Continued)

*Primary Examiner* — Rodney Mintz
(74) *Attorney, Agent, or Firm* — Vierra Magen Marcus LLP

(57) ABSTRACT

A moment frame is disclosed for a sloped roof construction. The moment frame includes a lateral bracing system having a high initial stiffness and including yield links capable of effectively dissipating energy generated within the lateral bracing system under lateral loads.

20 Claims, 12 Drawing Sheets

(56) References Cited

U.S. PATENT DOCUMENTS 8,074,359 B2 * 12/2011 Bong ..... E04B 1/2403 29/897.3
10,550,572 B2 * 2/2020 Webb ..... E04C 3/32
10,669,718 B2 * 6/2020 Pryor ..... E04B 1/2403
11,162,260 B2 * 11/2021 Pryor ..... E04B 1/98
2002/0184836 A1 * 12/2002 Takeuchi ..... E04B 1/2403 52/289
2004/0187430 A1 * 9/2004 Takeuchi ..... E04C 3/04 52/837
2004/0244330 A1 * 12/2004 Takeuchi ..... E04H 9/024 52/831
2005/0257451 A1 * 11/2005 Pryor ..... E04B 1/98 52/167.4
2006/0144006 A1 * 7/2006 Suzuki ..... E04H 9/024 52/655.1
2010/0205891 A1 * 8/2010 Bong ..... E04B 1/2403 52/655.1
2013/0001383 A1 * 1/2013 Jay ..... E04B 1/2403 248/214
2013/0200227 A9 * 8/2013 Jay ..... E04B 1/2403 248/214
2019/0010700 A1 * 1/2019 Webb ..... E04C 3/14
2019/0292783 A1 * 9/2019 Pryor ..... E04C 3/38
2019/0330873 A1 * 10/2019 Richard ..... E04H 9/024
2020/0109556 A1 4/2020 Pryor
2020/0291653 A1 * 9/2020 Pryor ..... E04C 3/04
2020/0354947 A1 * 11/2020 Richard ..... E04B 1/2403
2023/0117355 A1 * 4/2023 Robinson ..... E04B 1/2403 52/167.1

OTHER PUBLICATIONS

English language Abstract for FR2228920 published Dec. 6, 1974.
English language machine translation for DE202008012407 published Mar. 26, 2009.

* cited by examiner

MOMENT FRAME FOR A SLOPED ROOF CONSTRUCTION

PRIORITY DATA

This application claims priority to U.S. Provisional Patent Application No. 63/150,460, entitled "MOMENT FRAME FOR A SLOPED ROOF CONSTRUCTION", filed Feb. 17, 2021, which application is incorporated herein by reference in its entirety.

BACKGROUND OF THE INVENTION

Field of the Invention

The present invention relates to hysteretic damping for structures used in sloped roof constructions, and in particular to a lateral bracing system constructed to provide a high degree of energy dissipation through hysteretic damping along with high initial stiffness so that energy is dissipated at low displacement thresholds within a sloped roof construction.

Description of the Related Art

Shear stresses due to natural phenomena such as seismic activity and high winds can have devastating effects on the structural integrity of sloped roof constructions. Lateral forces generated during such natural phenomena may cause the top portion of a wall to move laterally with respect to the bottom portion of the wall, which movement can result in damage or structural failure of the wall and, in some instances, collapse of the building.

In constructions such as residences, warehouses and small buildings, lateral bracing systems were developed to counteract the potentially devastating effects of shear stress on the structural integrity of light-framed constructions. Although various designs are known, one type of lateral bracing system includes vertical studs spaced from each other and beams affixed to and extending between the studs. In constructions including sloped roofs, the beams may extend at an obtuse or acute angle from the vertical columns.

Many conventional lateral bracing systems perform well initially under lateral loads, but yield and fail upon the repetitive lateral loads which often occur during significant seismic activity and high winds. Upon appreciable yield or failure of the lateral bracing system, the entire system must be replaced.

SUMMARY

The present technology relates to a lateral bracing system of a moment frame for use in a slope roof construction. The moment frame comprises a pair of spaced apart vertical columns, and a pair of beams extending from the columns at the angle of the roof and connected to each other at an apex of the roof. Each column may include a top portion with a connecting face perpendicular to an axial length of the beam when assembled.

The moment frame may further include a pair of lateral bracing systems used to attach the beams to the columns. Each lateral bracing system may further include a pair of buckling-restrained braced devices, affixed to the top and bottom flanges of the beam. Each buckling-restrained braced device comprises a yield link affixed between the beam and column, and a buckling restraint plate covering a portion of the yield link. In one embodiment, the yield link may affix to the end face of the column with a right-angle plate (perpendicular to a major plane of the yield link). In a second embodiment, the yield link may affix to a top edge of the column with a flat plate (parallel to a plane of the yield link). By providing the connecting face of the column perpendicular to an axial length of the beam, the tensile and compressive forces exerted on the yield link by the beam and column are constrained to the plane of the yield link.

In one example, the present technology relates to a sloped roof construction, comprising: a beam having a major axis at a non-horizontal angle following a slope of the roof; a column comprising a connecting face configured to be oriented at an angle perpendicular to the major axis of the beam; a shear tab affixed between the column and beam, between a top and bottom flange of the beam; and a lateral bracing system affixed between the column and beam, including: first and second buckling-restrained braced devices, one each on the top and bottom flange of the beam, each buckling-restrained braced device comprising: a yield link comprising a first end connected to the column and a second end connected to the beam, the yield link comprising a section of narrowed width defining first and second notches on opposite sides of the yield link, the yield link configured to yield in tension and compression at the narrowed width section to dissipate stress within the construction upon a lateral load applied to the beam and/or column; first and second spacers fitting within the first and second notches, respectively; a buckling restraint plate configured to mount over the yield link and spacers to sandwich the yield link and spacers between the buckling restraint plate and the face of one of the top and bottom flanges of the beam.

In a further example, the present technology relates to a sloped roof construction, comprising: a column comprising: a top edge at a non-horizontal angle following a slope of the roof, and a connecting face adjacent the top edge; a beam having a major axis at the non-horizontal angle following the slope of the roof; a shear tab affixed between the column and beam, between a top and bottom flange of the beam; and a lateral bracing system affixed between the column and beam, including: first and second buckling-restrained braced devices, one each on the top and bottom flange of the beam, the first buckling-restrained braced device comprising: a first yield link comprising: a first end comprising a first planar section with a first surface configured to mount parallel to and against the top edge of the column, a second end comprising a second planar section with a second surface configured to mount parallel to and against the first flange of the beam, and a section of narrowed width between the first and second ends, the narrowed width section defining first and second notches on opposite sides of the first yield link, the first yield link configured to yield in tension and compression at the narrowed width section to dissipate stress within the construction upon a lateral load applied to the beam and/or column; first and second spacers fitting within the first and second notches, respectively; and a buckling restraint plate configured to mount over the first yield link and spacers to sandwich the first yield link and spacers between the buckling restraint plate and the first flange of the beam.

In another example, the present technology relates to a sloped roof construction, comprising: a vertical column comprising: a top edge at a non-horizontal angle following a slope of the roof, and a connecting face adjacent the top edge, the connecting face provided at a non-vertical angle perpendicular to the slope of the roof; a beam having a major axis at the non-horizontal angle following the slope of the roof; and a lateral bracing system affixed between the column and beam, including: first and second buckling-restrained braced devices, one each on a top flange and a bottom flange of the beam. The first buckling-restrained braced device comprises: a first yield link comprising: a first end comprising a first planar section with a first surface configured to mount parallel to and against the top edge of the column, a second end comprising a second planar section with a second surface configured to mount parallel to and against the first flange of the beam, and a first section of narrowed width between the first and second ends, the first narrowed width section defining first and second notches on opposite sides of the first yield link, the first yield link configured to yield in tension and compression at the first narrowed width section to dissipate stress within the construction upon a lateral load applied to the beam and/or column; and a first buckling restraint plate configured to mount over the first yield link to sandwich the first yield link between the buckling restraint plate and the first flange of the beam. The second buckling-restrained braced device comprises: a second yield link comprising: a first end comprising a perpendicular plate configured to mount parallel to and against the connecting face of the column, a second end comprising a planar section with a surface configured to mount parallel to and against the second flange of the beam, and a second section of narrowed width between the first and second ends, the narrowed width section defining first and second notches on opposite sides of the yield link, the yield link configured to yield in tension and compression at the second narrowed width section to dissipate stress within the construction upon a lateral load applied to the beam and/or column; and a second buckling restraint plate configured to mount over the second yield link to sandwich the second yield link between the buckling restraint plate and the second flange of the beam.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

DETAILED DESCRIPTION

The present invention will now be described with reference to FIGS. 1 through 12, which in embodiments relate to a lateral bracing system for a sloped roof construction. The lateral bracing system has a high initial stiffness and includes yield links capable of effectively dissipating energy generated within the lateral bracing system under lateral loads. It is understood that the present invention may be embodied in many different forms and should not be construed as being limited to the embodiments set forth herein. Rather these embodiments are provided so that this disclosure will be thorough and complete and will fully convey the invention to those skilled in the art. Indeed, the invention is intended to cover alternatives, modifications and equivalents of these embodiments, which are included within the scope and spirit of the invention as defined by the appended claims. Furthermore, in the following detailed description of the present invention, numerous specific details are set forth in order to provide a thorough understanding of the present invention. However, it will be clear to those of ordinary skill in the art that the present invention may be practiced without such specific details.

Figure 1:
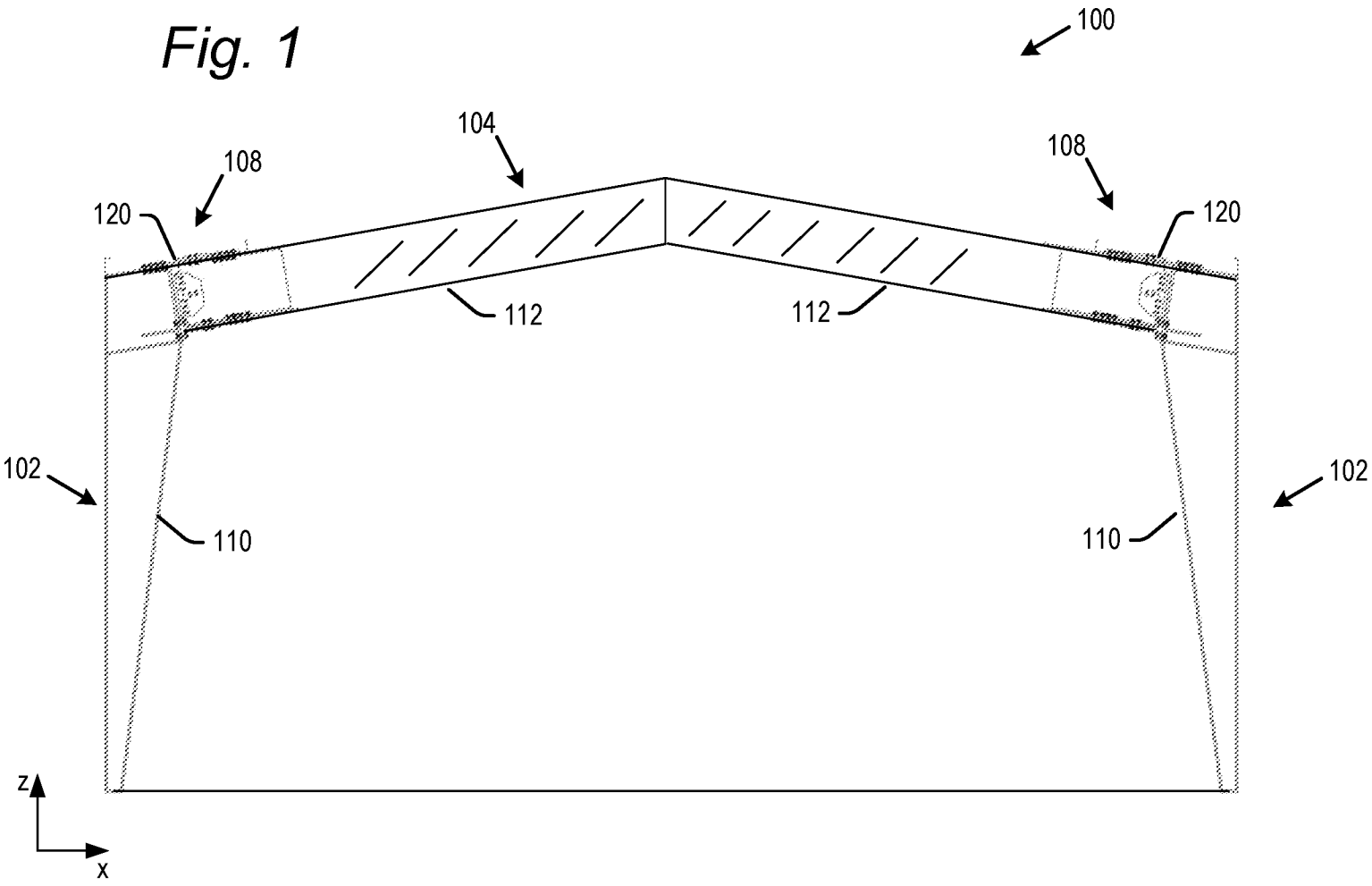
FIG. 1 is a cross-sectional view through a sloped roof construction showing a moment frame.

Referring now to FIG. 1, there is shown a construction 100 comprising vertical walls 102 and sloped roof 104. In the illustrated embodiment, the roof 104 comes to an apex approximately midway between walls 102. In a further embodiment explained below, the roof 104 may have an apex at one or the other of walls 102, and then slope downward continuously to the other wall. The construction 100 may be supported by one or more moment frames 108 comprising a pair of spaced apart vertical columns 110, and a pair of beams 112 extending from the columns 110 at the angle of the roof and connected to each other at an apex 114. The angle between the columns 110 and beams 112 may for example range between 95° and 135°, though the slope of the roof, and angle between the columns 110 and beams 112 may be lesser or greater than that with the understanding that the angles in the embodiment of FIG. 1 are greater than 90°. While FIG. 1 shows one such lateral bracing system 110, there may be multiple such lateral bracing systems in parallel planes along the length of the construction (i.e., into and out of the page of FIG. 1).

The moment frame 108 may further include a pair of lateral bracing systems 120 coupling the columns 110 and beams 112 to each other on each side of the construction 100. Each lateral bracing system 120 on opposed sides of a moment frame 108 may be the mirror image of the other, though they need not be in further embodiments. As such, one lateral bracing system 120 is described below, with the understanding that the other lateral bracing system in a given moment frame 108 includes the identical components in mirror image.

Figure 2:
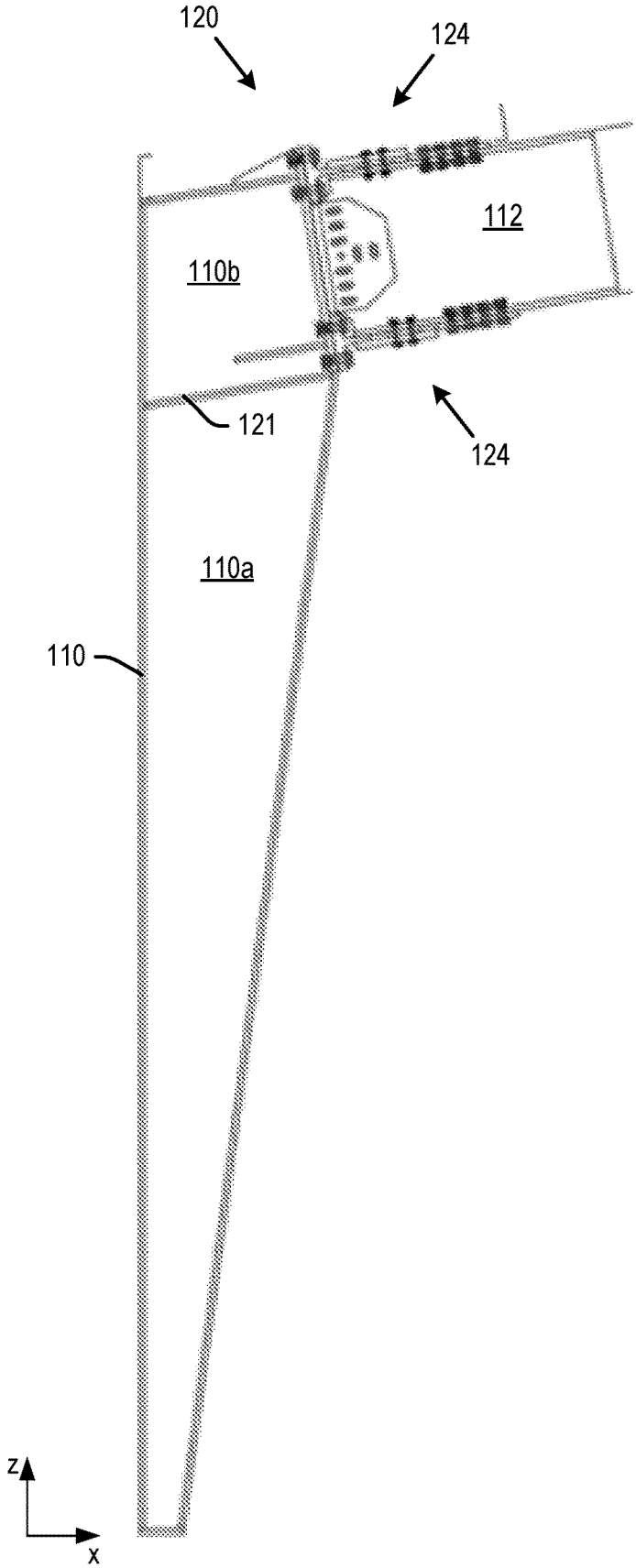
FIG. 2 is a front view of the lateral bracing system according to a first embodiment of the present technology.

FIG. 2 is a side view of one side of the moment frame showing a column 110 connected to a beam 112 (a portion of which is shown) by a lateral bracing system 120. Each of the column 110 and beam 112 may be formed of structural steel, having first and second flanges and a web extending between the first and second flanges. In one example, the flanges may have a thickness of $1\frac{13}{16}$ inches, though the thickness of the flanges may vary in further embodiments. In one example, the web may have a thickness of 1 inch, ¾ inch or ½ inch, though the thickness of the web may vary in further embodiments. The flanges of the column 110 and/or beam 112 may be formed in a so-called standard structural W-shape, orthogonal to the surfaces of the web. Alternatively, the flanges may be formed in a so-called S-section, where the interior surfaces form an angle greater than 90° with the surfaces of the web. Other configurations of beams are contemplated.

Each column 110 may be formed of primary portion 110*a*, extending most of the length of column 110, and a top portion 110*b* formed at a top of column 110. The primary and top portions may be formed integrally with each other, and may for example include a stiffener flange 121 at a boundary between the primary and top portions. In further embodiments, the primary and top portions may be welded, bolted or otherwise affixed to each other after they are formed. The primary portion 110*a* may comprise a first flange (affixed to wall 102) extending vertically, and a second flange which is angled relative to vertical so that the web of the primary portion 110*a* tapers along its length to be wider at the top of the primary portion 110*a* than at a base of the primary portion 110*a*. In one example, the top of the primary portion 110*a* may have a width of 24" to 60", and it may taper to a bottom having a width of 8" to 12". These dimensions are by way of example only, and the top and/or bottom dimensions may vary in further embodiments. Both flanges of the primary portion 110*a* may be vertical and parallel to each other in further embodiments. The beams, while shown as constant depth, might also taper in depth along their length.

The top portion 110*b* may comprise a first flange (affixed to wall 102) extending vertically from the first flange of the primary portion 110*a*. The top portion 110*b* may have a second, non-vertical flange. In embodiments the second flange tapers inward from bottom to top, so that the web of the top portion 110*b* is wider at its base than at its top. The second flange of the top portion 110*b* of column 110 forms a connecting face to which the beam 112 is affixed via a lateral bracing system.

In embodiments, the second flange of the top portion 110*b* is provided at an angle that is perpendicular to a major axis of the beam 112 (i.e., along the beam axial length) and a slope of the roof 104 when assembled. As explained below, this configuration ensures that the forces exerted on a yield link of the lateral bracing system between the beam and column remain in the major plane of the yield link.

Figure 3:
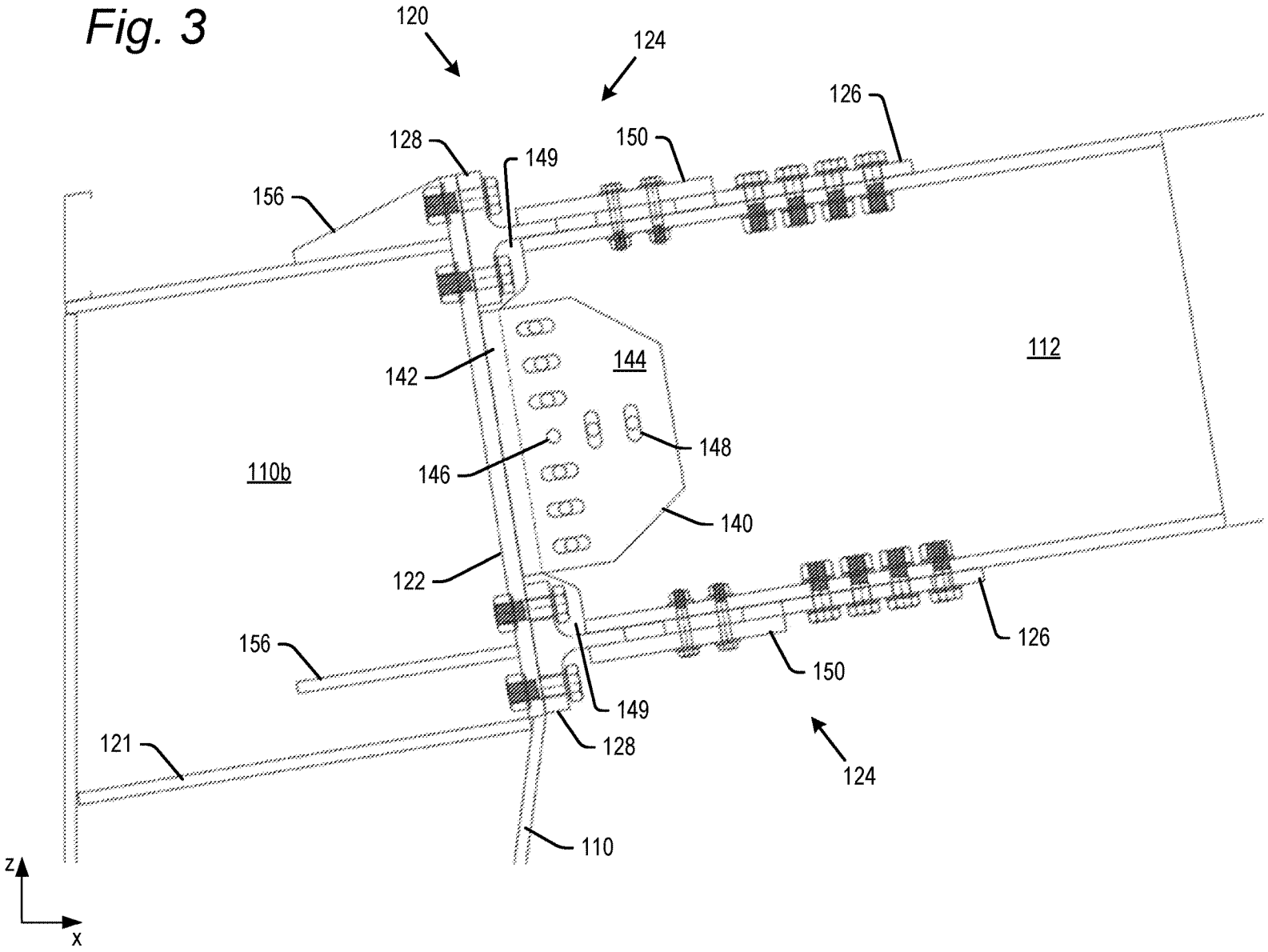
FIG. 3 is an enlarged front view showing a portion of the lateral bracing system of FIG. 2.

FIG. 3 is an enlarged view showing the lateral bracing system 120 connecting an end face of beam 112 to the connecting face (the second flange) of the top portion 110*b* of column 110. The connecting face is designated as 122 in FIG. 3. The lateral bracing system 120 is comprised of a pair of buckling-restrained braced devices 124, one on each of the top and bottom flanges of beam 112. Each buckling-restrained braced device 124 includes a "dog-bone" shaped yield link 126 shown in edge view in FIG. 3, top view in FIG. 4 and perspective view in FIG. 5. According to a first embodiment of the present technology, each yield link 126 may include a perpendicular plate 128 forming a flange at a first end of the link that is perpendicular to a length and major plane of the yield link 126. The perpendicular plate 128 of each link 126 may include bolt holes 130 (FIG. 4) allowing the plates 128 to bolt to connecting face 122 at a top and bottom of beam 112.

Figure 4:
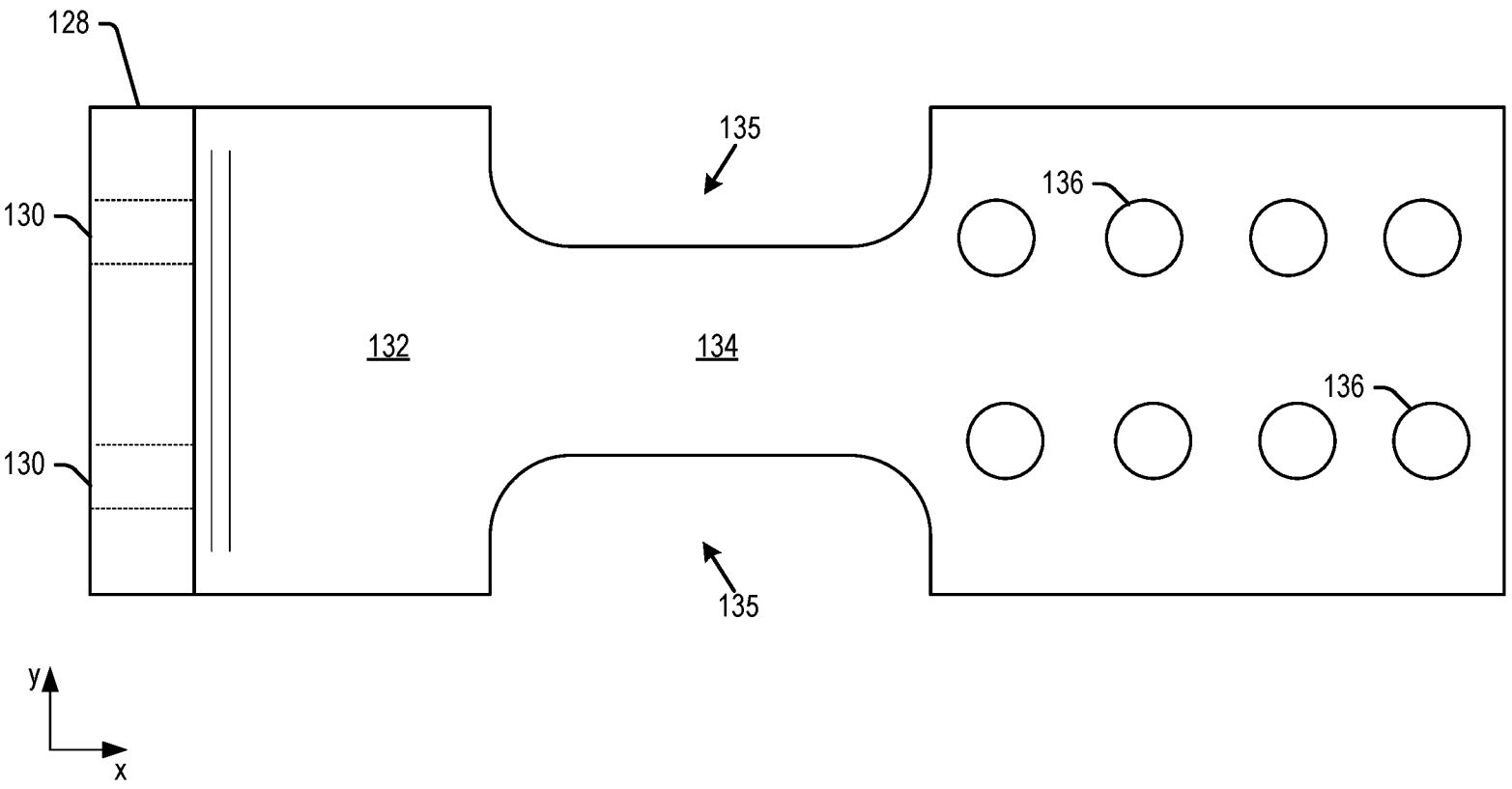
FIG. 4 is a top view of a yield link used in the lateral bracing system according to FIG. 2.

As seen for example in FIG. 4, the yield link 126 includes a planar portion 132 extending orthogonally from plate 128 and having a reduced diameter section 134 defining a pair of notches 135. The planar portion 132 need not be orthogonal to plate 128 in further embodiments. Upon tensile and compressive loads on yield link 126 above a predefined threshold, the yield link 126 will yield at the reduced diameter section 134. The section 134 may alternatively be the same diameter as adjacent sections, but provided with a lower yield strength so that the yield link 126 yields at section 134 above a predefined threshold.

Yield link 126 may further include bolt holes 136 in planar section 132, at a second end of the yield link 126 opposite plate 128. Bolt holes 136 are provided to bolt holes 130, and are provided to allow bolting of the second end of the yield links to the top and bottom flanges of beam 112.

A shear tab 140 may further be affixed between the connecting face 122 and the web of beam 112. The shear tab 140 may include a flange 142 parallel to connecting face 122 and configured to be bolted or welded to connecting face 122. Shear tab 140 further include plate 144 parallel to the web of beam 112, and configured to be bolted to the web of beam 112. In particular, plate 144 includes a central circular hole 146 for bolting plate 144 to the web of beam 112. Plate 144 further includes oblong holes 148 for bolting plate 144 to the web of beam 112, while allowing rotation of the beam relative to the column. As explained below, upon lateral loads above a predefined threshold, the beam will rotate relative to the column. The lateral bracing system is configured to allow such rotation, which will take place about an axis through central bolt hole 146. The oblong holes 148 have slots oriented tangential to radii from central bolt hole 146, and will allow such rotation without damage to the shear tab or beam web. At the same time, the holes 146 and 148 support the beam 112 against gravity on column 110. The number, position and size of the oblong holes 148 is shown by way of example, and the number, position and/or size may vary in further embodiments.

As seen in FIG. 3, the end face of the beam 112 adjacent the column 110 may be cut back at the top and bottom flanges to define notches 149. The notches 149 are formed in such a way so that a line between the ends of the cut back top and bottom flanges passes through a center of bolt hole 146. The notches 149 allow rotation of the beam 112 relative to the column 110 without binding of the beam at its top and bottom flanges.

Figure 5:
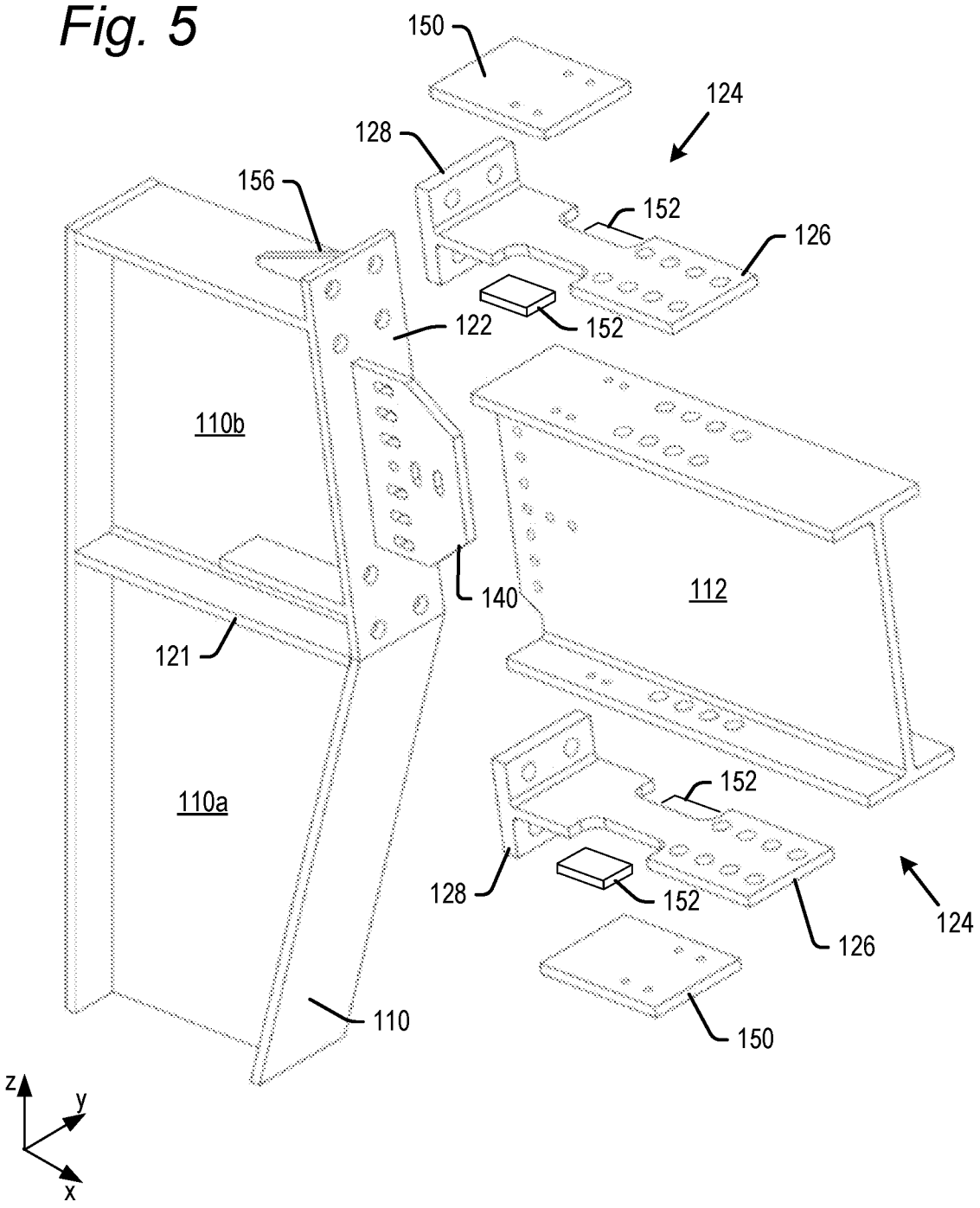
FIG. 5 is an exploded perspective view of the lateral bracing system according to FIG. 2.

Referring to FIGS. 3 and 5, each of the two buckling-restrained braced devices 124 may further include a buckling restraint plate (BRP) 150. After the yield link 126 has been bolted or otherwise affixed between the column 110 and beam 112, the BRP 150 may be bolted over the yield link 126. The yield link 126 performs predictably in tension, but the BRP 150 is provided to prevent unpredictable, out of plane buckling of the yield link in compression. As seen in FIG. 5, a pair of spacers 152 may be mounted within notches 135 at the reduced diameter section 134. Thereafter, one or more bolts may pass through the BRP 150, through each spacer 152 on opposed sides of the yield link 126, and then into the flange of the beam 112 to affix the BRP 150 to each of the two buckling-restrained braced devices 124 on the top and bottom of the beam.

The spacers 152 may be the same thickness as the yield link 126, and may take up most or substantially all of the empty space defined by notches 135, for example between 60% to 99%, or for example 80% to 90% of the area of the notches 135. In this way, the spacers 152 ensure uniform load distribution of the BRPs 150 on the yield links 126 when the BRPs 150 are bolted over the yield links 126.

The lateral bracing systems 120 in a moment frame 108 have the advantage that they may be easily assembled on-site. In one example, the yield link 126 and shear tab 140 may be assembled onto the column 110 before arrival at the job site, or before column 110 is erected. Thereafter, once the column 110 and beam 112 are positioned, the opposite ends of the yield link and shear tab may be affixed to the beam. These connections may for example be made by bolting and no on-site welding is required.

In operation, the pair of buckling-restrained braced devices 124 operate in tandem to oppose rotation of the beam 112 relative to the column 110 (i.e., rotation about the shear tab 140) under a lateral load. Attempted rotation in a first direction will place the first of the devices 124 in tension and the second of the devices in compression. Attempted rotation in the opposite direction will place the first of the devices in compression and the second in tension.

The yield link 126 of the respective devices 124 provides high initial stiffness and tensile and compression resistance to relative movement between the column 110 and the beam 112 under lateral loads, but provides stable yielding and hysteretic energy dissipation under lateral loads above a predictable and controlled level. In particular, the bending strength of the column and beam may be designed to exceed the moment capacity of the yield links 126, and in particular, the reduced diameter section 134 of yield links 126. Thus, the yield links 126 yield under lateral loads before yielding or failure of the column or beam, and any damage is limited to the yield links which may be easily removed and replaced.

The BRPs 150 prevent buckling of the yield links under a compressive load. The shear tab 140 is provided to oppose beam end shear (i.e., beam shear orthogonal to the major axis of beam 112) under vertical and lateral frame loads.

Upon lateral loads, the perpendicular plates 128 of the yield links 126 exert forces on the connecting face 122 of the column 110 to which the yield links are attached. Accordingly, stiffening plates 156 may optionally be affixed to a side of the connecting face 122 opposite that receiving the yield links to oppose the forces exerted by the yield links. A stiffening plate 156 may be mounted perpendicularly to the web of top column portion 110*b*, on one or both sides of the web, to oppose the forces on the portion 110*b* from the bottom yield link 126. The length of the stiffening plate 156 may be aligned with the major plane of the yield link (perpendicular to the connecting face 122).

A second stiffening plate 156 may be mounted on top of the columns 110 to oppose the forces on the portion 110*b* from the top yield link 126. The second stiffening plate 156 may be mounted on a top edge of the top column portion 110*b*, in the plane of the web of top portion 110*b*. As seen in FIG. 3, a top section of the connecting face 122 may extend above the top edge of column portion 110*b* to receive the perpendicular plate 128 of the upper yield link 126. The stiffening plate 156 may be positioned against this top portion of the connecting face 122, on a side of the connecting face opposite the upper yield link 126. The stiffening plates 156 may be affixed as by welding, bolting or gluing.

Figure 6:
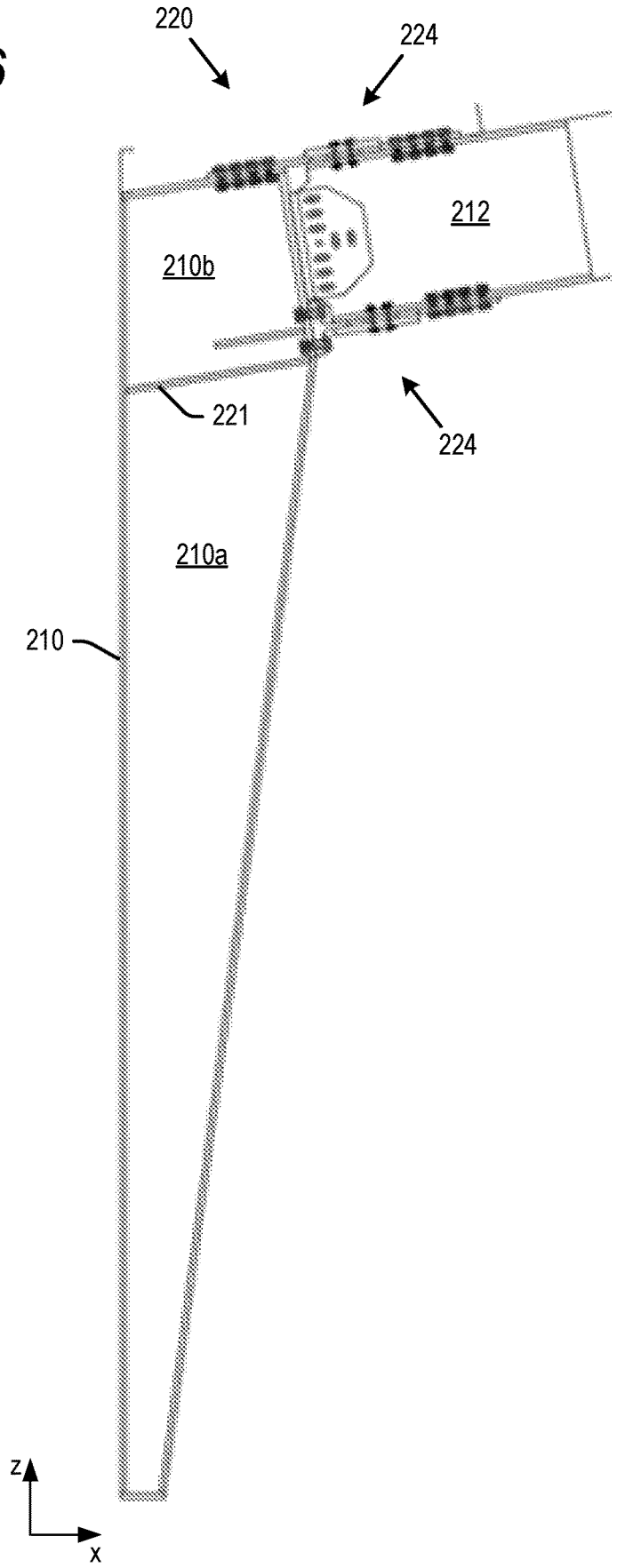
FIG. 6 is a front view of the lateral bracing system according to a second embodiment of the present technology.

Embodiments of the present technology shown in FIGS. 2-5 may be referred to as a perpendicular plate lateral bracing system, given that the yield link 126 includes perpendicular plate 128, orthogonal to the major plane of yield link 126. FIGS. 6-9 illustrate a further embodiment of the present technology referred to as a flat plate lateral bracing system. The flat plate lateral bracing system is similar in several respects to the perpendicular plate lateral bracing system, with differences noted below. Referring initially to FIG. 6, there is shown a side view of one side of the moment frame illustrating a column 210 connected to a beam 212 (a portion of which is shown) by a flat plate lateral bracing system 220. Unless otherwise noted below, the column 210 and beam 212 may have the same configuration as column 110 and beam 112, respectively.

Each column 210 may be formed of primary portion 210*a*, extending most of the length of column 210, and a top portion 210*b* formed at a top of column 210. The top portion 210*b* may comprise a first flange (affixed to wall 102) extending vertically from the first flange of the primary portion 210*a*. The top portion 210*b* may have a second flange extending at a non-vertical angle. In embodiments the second flange tapers inward from bottom to top, so that the web of the top portion 210*b* is wider at its base than at its top. The second flange of the top portion 210*b* of column 210 forms a connecting face 222 to which the beam 212 is affixed.

In embodiments, the connecting face of the top portion 210*b* is provided at an angle that is perpendicular to a major axis of the beam 212 and a slope of the roof 104 when assembled. As explained below, this configuration ensures that the forces exerted on the yield link between the beam and column remain in the plane of the yield link.

Figure 7:
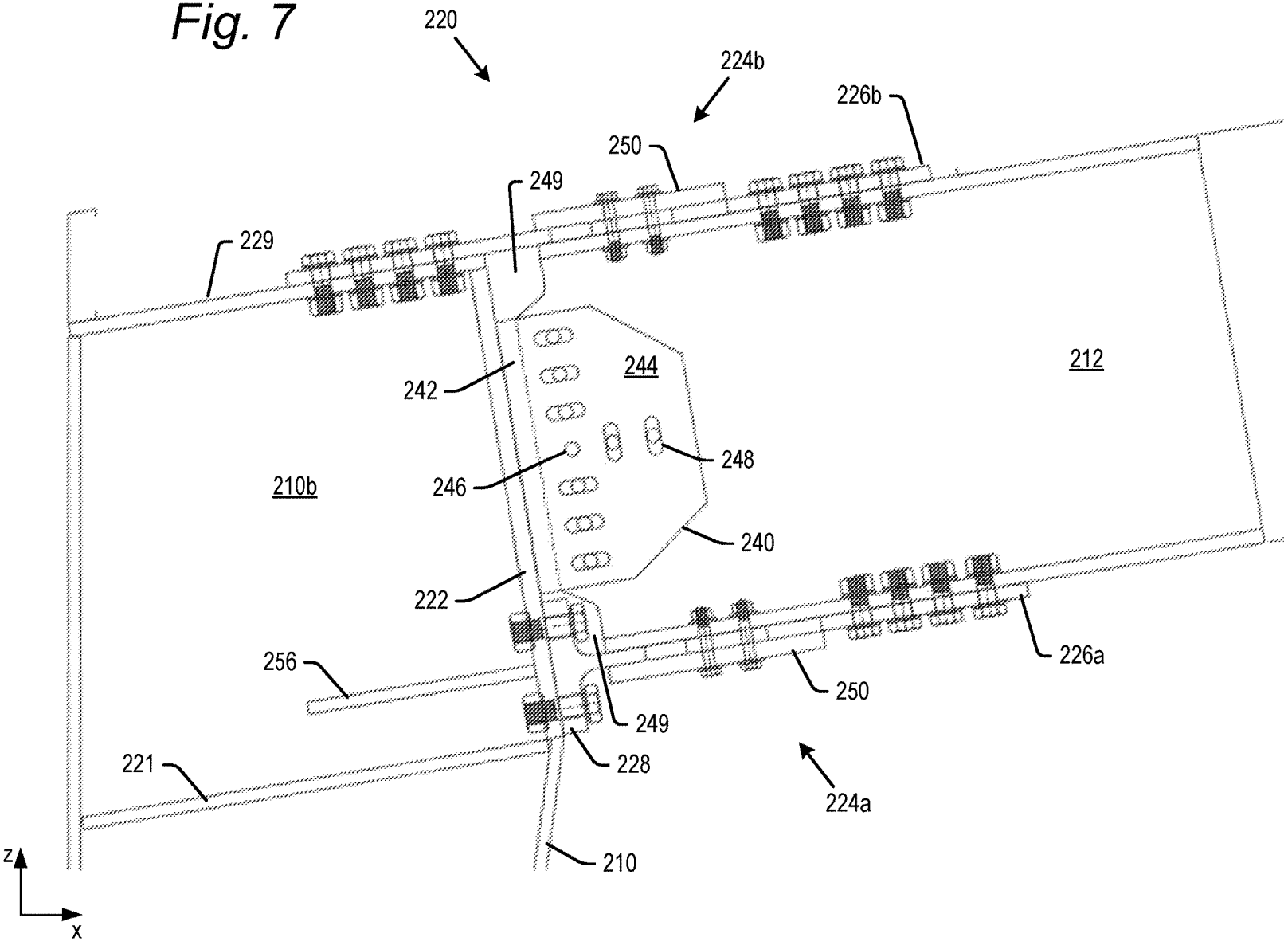
FIG. 7 is an enlarged front view showing a portion of the lateral bracing system of FIG. 6.
Figure 8:
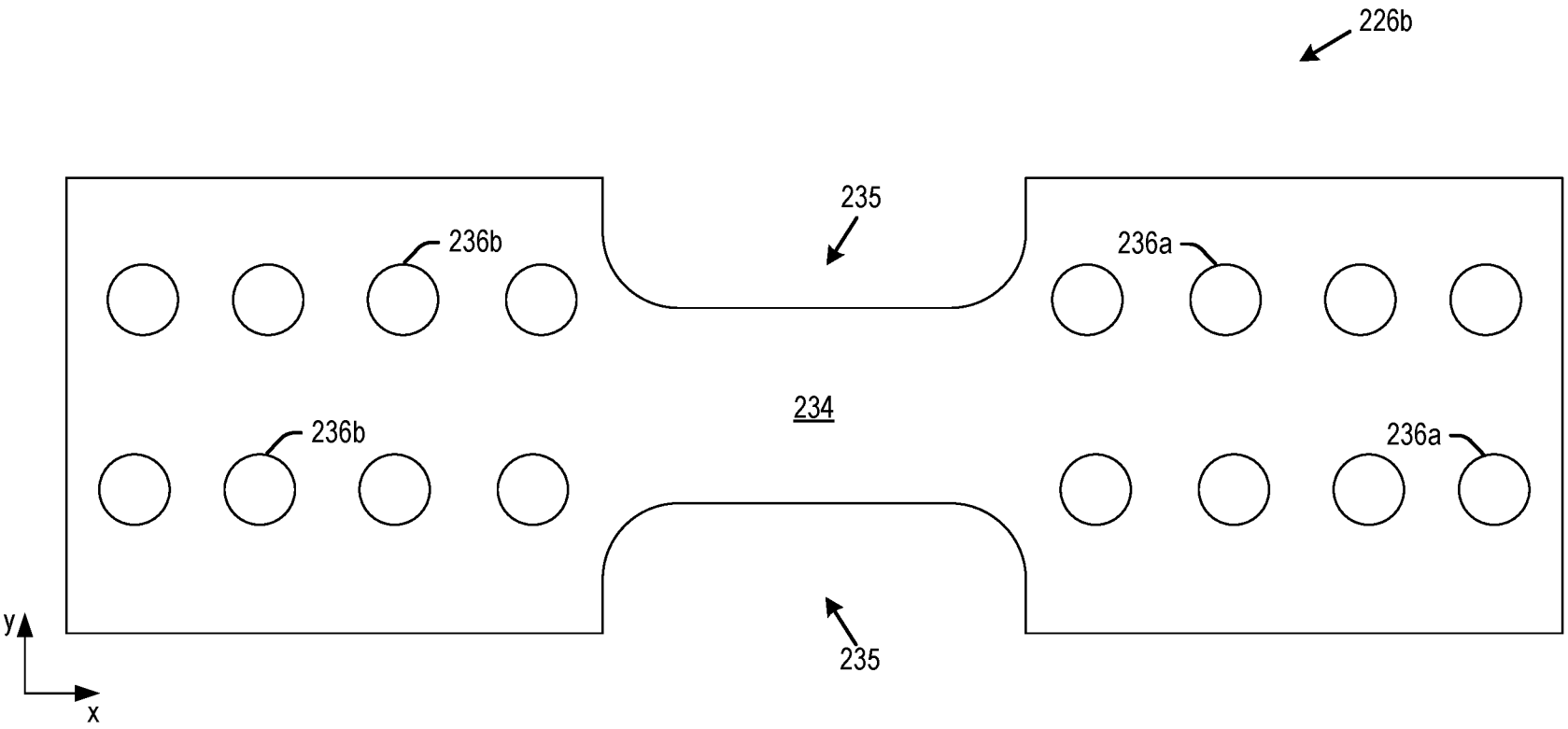
FIG. 8 is a top view of a yield link used in the lateral bracing system according to FIG. 6.
Figure 9:
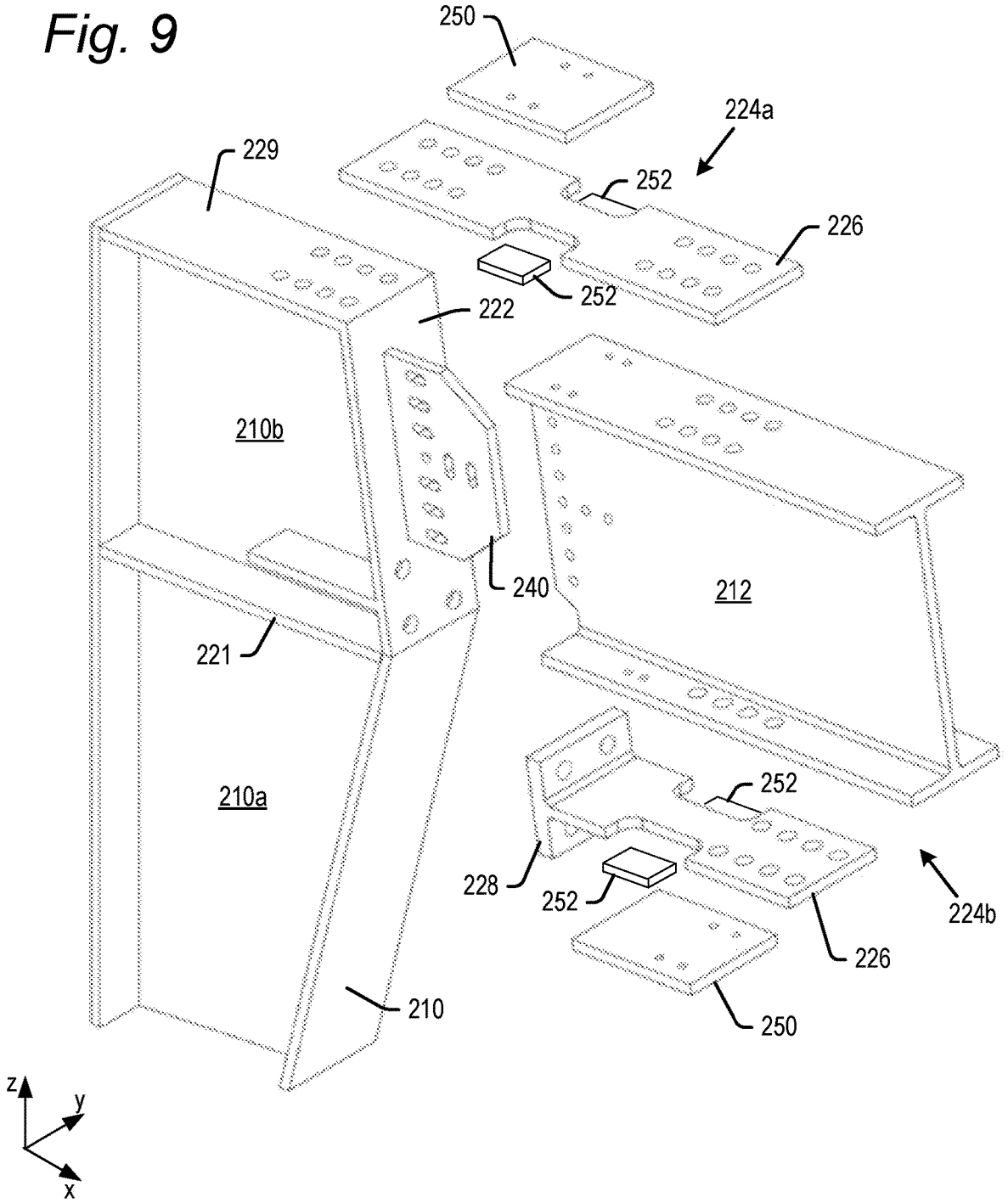
FIG. 9 is an exploded perspective view of the lateral bracing system according to FIG. 6.
Figure 10:
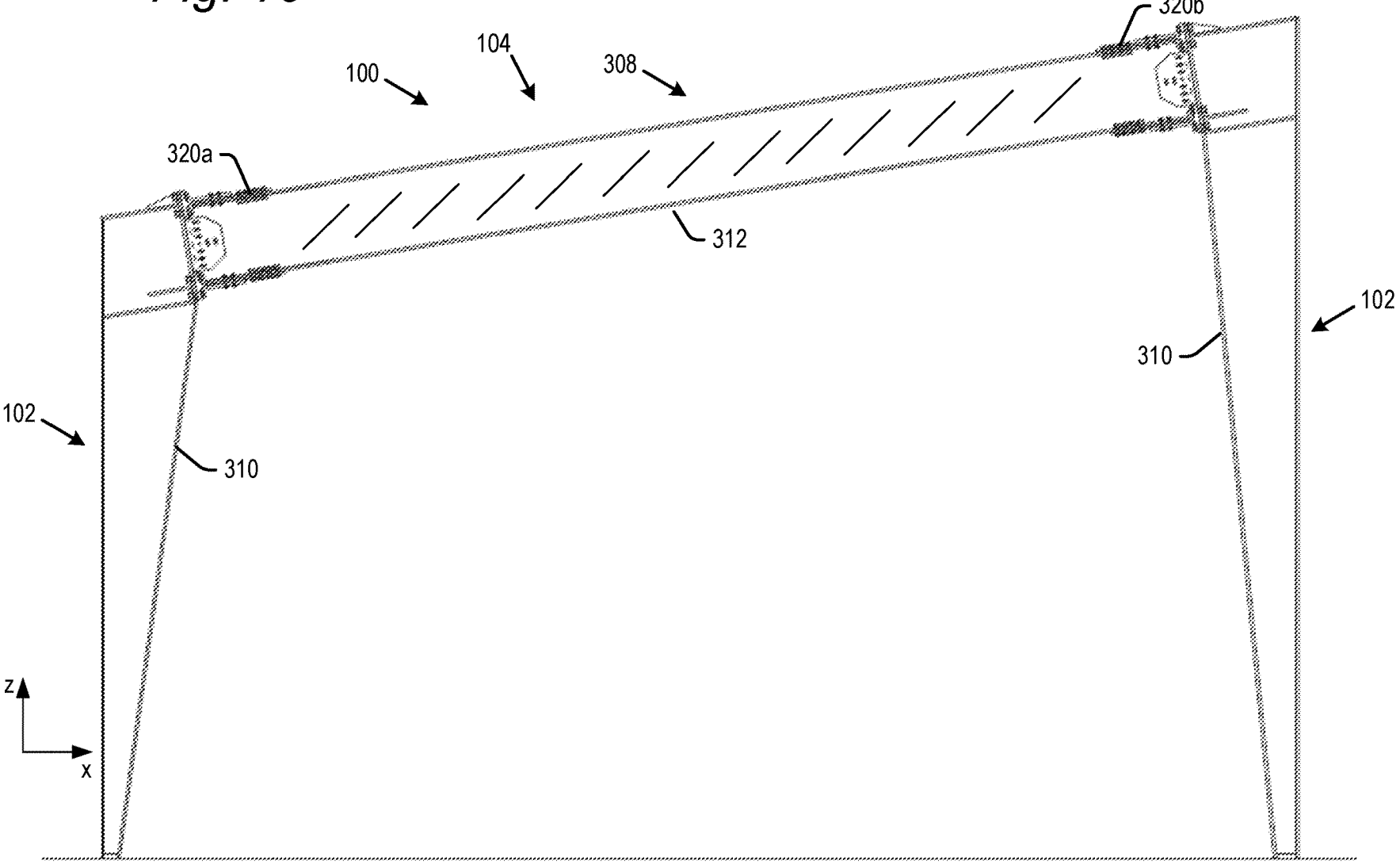
FIG. 10 is a cross-sectional view through an alternative sloped roof construction showing a moment frame.

FIG. 7 is an enlarged view showing the lateral bracing system 220 connecting an end face of beam 212 to the connecting face 222 of the top portion 210*b* of column 210. The lateral bracing system 220 is comprised of a pair of buckling-restrained braced devices 224, one on each of the top and bottom flanges of beam 212. Unless otherwise noted below, the lateral bracing system 220 and the pair of buckling-restrained braced devices 224 may be the same as the lateral bracing system 120 and the pair of buckling-restrained braced devices 124, respectively, described above.

In the second embodiment, the first (bottom) buckling-restrained braced device 224*a* includes a yield link 226*a*, and the second (top) buckling-restrained braced device 224*b* includes a yield link 226*b*. The bottom yield link 226*a* may be identical to the bottom yield link 126 described above, including a perpendicular plate 228 forming a flange at a first end of the link that is perpendicular to a length and major plane of the yield link 226*a*. The perpendicular plate 228 of link 226*a* may include bolt holes 230, as described above with respect to FIG. 4, allowing the plate 228 to bolt to connecting face 222 at a bottom of beam 212.

In accordance with this second embodiment, the top yield link 226*b* may have no perpendicular plate, but may instead be a generally flat, planar component along its entire length. As shown in edge view in FIG. 7, top view in FIG. 8 and perspective view in FIG. 9, the yield link 226*b* is generally planar with a reduced diameter section 234 defining a pair of notches 235. Upon tensile and compressive axial loads on yield link 226*b* above a predefined threshold, the yield link 226*b* will yield at the reduced diameter section 234 as described above with respect to yield link 126. Yield link 226*b* may further include two sets of bolt holes 236*a* and 236*b* (collectively, bolt holes 236) at first and second opposed ends of the yield link 226*b*. Bolt holes 236*a* are provided to allow bolting of a first end of the yield link 226*b* to the top flange of beam 212. Bolt holes 236*b* are provided to allow bolting of a second end of the yield link 226*b* to a top edge 229 of the top column portion 210*b*.

The top edge 229 is provided at a non-horizontal angle matching the major axis of the beam 212 and following a slope of the roof 104. The top edge 229 is also coplanar with the top flange of beam 212. Thus, the flat plate yield link 226*b* may lie flat on top of both the top flange of beam 212 and the top edge 229 of column 210, and be bolted to the top flange of beam 212 and the top edge 229 via bolt holes 236. While the top of the connecting face 122 extended above the top edge of top column portion 110*b* in the embodiment of FIG. 4, the top of the connecting face 222 ends at the top edge 229 in this second embodiment shown in FIG. 7.

A shear tab 240 may further be affixed between the connecting face 222 and the web of beam 212. The shear tab 240 may be structurally and operationally identical to shear tab 140. The beam 212 may include notches 249 at its top and bottom flanges that are structurally and operationally identical to notches 149. Each of the two buckling-restrained braced devices 224 may further include a buckling restraint plate (BRP) 250, and spacers 252 in notches 235 of both yield links 226*a*, 226*b*. BRP 250 and spacers 252 may be structurally and operationally identical to BRP 150 and spacers 152, respectively.

In operation, the pair of buckling-restrained braced devices 224 operate in tandem to oppose rotation of the beam 212 relative to the column 210 (i.e., rotation about the shear tab 240) under a lateral load. Attempted rotation in a first direction will place the first of the devices 224 in tension and the second of the devices in compression. Attempted rotation in the opposite direction will place the first of the devices in compression and the second in tension.

The yield links 226*a*, 226*b* of the respective devices 224 both provide high initial stiffness and tensile and compression resistance to relative movement between the column 210 and the beam 212 under lateral loads, but provide stable yielding and hysteretic energy dissipation under lateral loads above a predictable and controlled level. The yield link 226*a* may transmit tensile and compressive loads (before yielding) to and from the column top portion 210*a* via the perpendicular plate 228. The yield link 226*b* may transmit tensile and compressive loads (before yielding) to and from the column top portion 210*a* via the bolts in bolt holes 236*b*. Stiffening plate 256 may optionally be affixed to the connecting face 222 to oppose the tensile and compressive forces exerted by the yield link 226*a*. Stiffening plate 256 may be structurally and operationally identical to stiffening plate 156 described above.

In the embodiments described above, the roof 104 has an apex generally midway between opposed walls 102, such that both beams 112/212 on opposed walls 102 slope upward from their connection to columns 110/210. In a further embodiment of the present technology shown in FIGS. 10-12, the roof 104 may have an apex at one of walls 102, and slope downward to the opposed wall 102. In such embodiments, a moment frame 308 includes a pair of opposed columns 310 and a beam 312 may extending therebetween. The embodiment shown in FIG. 10 includes a single beam 312 between columns 310, but there may be more than one beam between columns 310 in further embodiments.

The moment frame 308 includes a pair of lateral bracing systems 320*a* and 320*b*, one of which couples the columns 310 and beam(s) 312 to each other on each side of the construction the moment frame 308. On a first side of construction 100, the beam 312 angles upward from the column 310, following the slope of the roof 104, and lateral bracing system 320*b* on that first side may be identical to the lateral bracing systems 120/220 described above in coupling the first column 310 to the beam 312.

Figure 11:
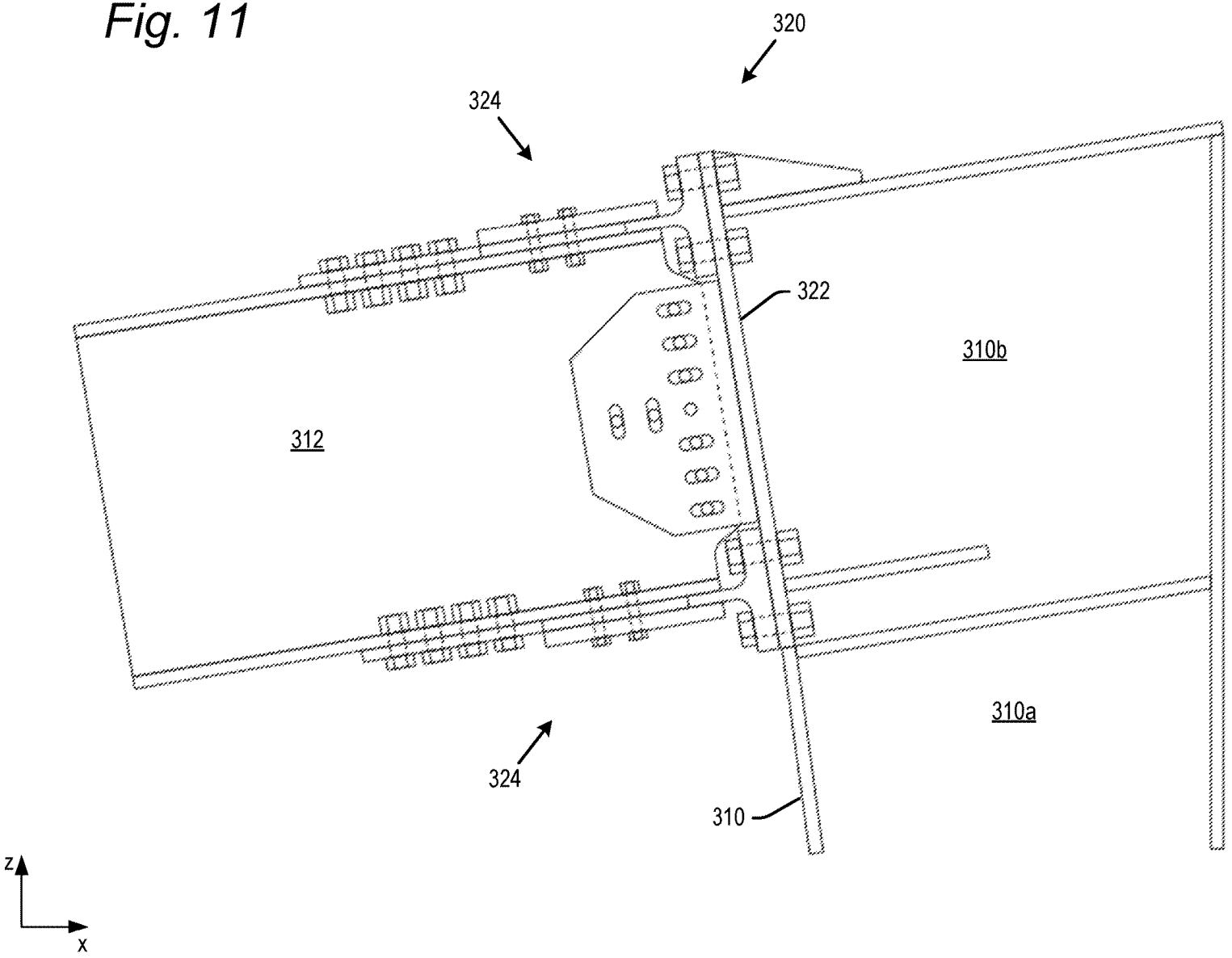
FIG. 11 is an enlarged front view showing a portion of a lateral bracing system according to a first embodiment of the present technology.
Figure 12:
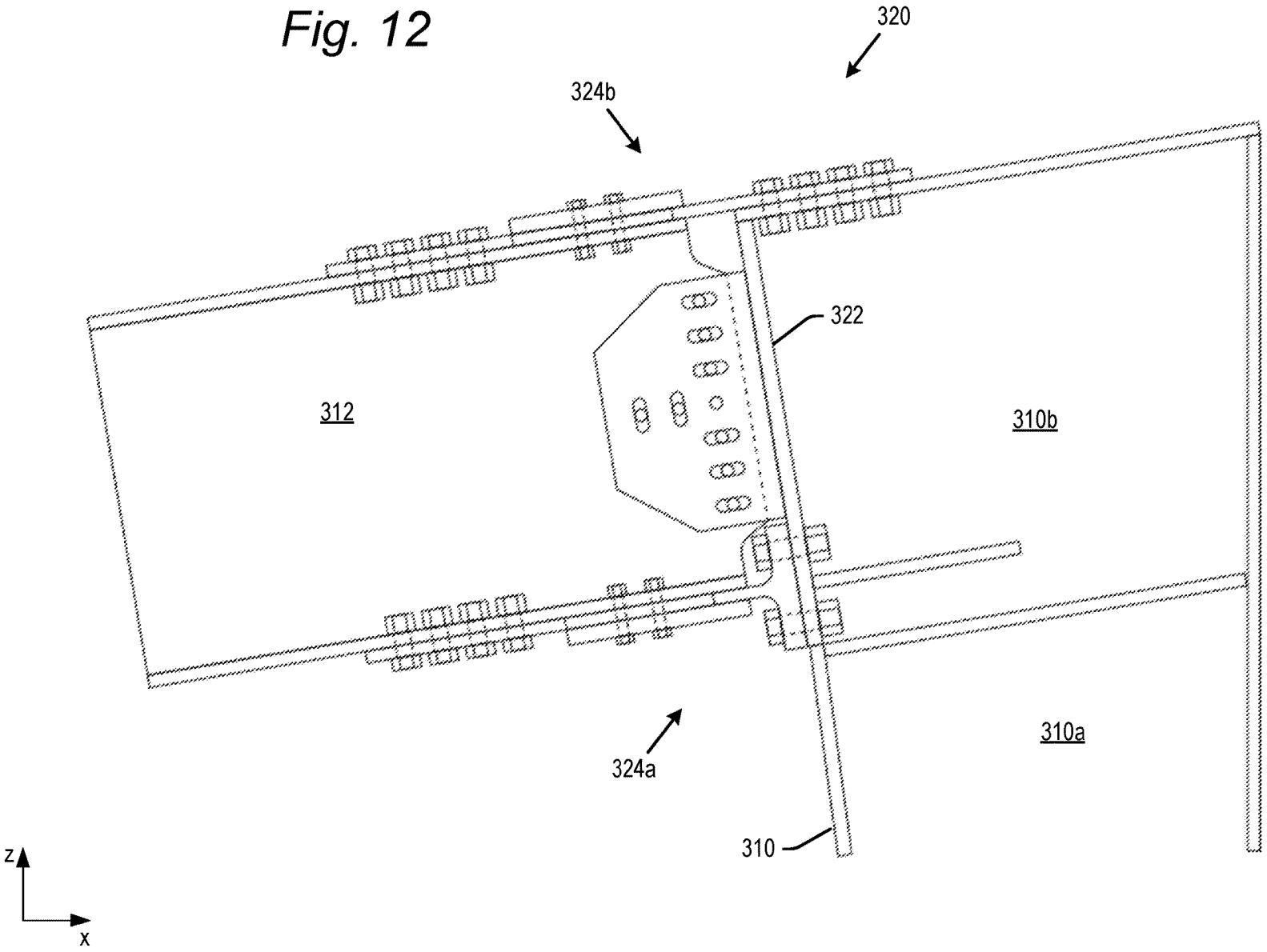
FIG. 12 is an enlarged front view showing a portion of a lateral bracing system according to a second embodiment of the present technology.

On the second side of the construction 100, the beam 312 angles downward from the column 310 at the lateral bracing system 320*b*. FIGS. 11 and 12 show enlarged partial front views of the column 310, beam 312 on the second side of construction 100, and the lateral bracing system 320*b* according to the two embodiments described above. Referring first to FIG. 11, the column 310 includes a primary portion 310*a* similar to primary portions 110*a* and 210*a* described above, extending most of the length of column 310, and a top portion 310*b* formed at a top of column 310. The primary portion 310*a* and top portion 310*b* may be similar to the embodiments described above. The column 310 further includes a top portion 310*b*. Unlike previously described embodiments, the top portion 310*b* includes a connecting face 322 that is angled downward. The angle of connecting face 322 is provided to be perpendicular to a major axis of beam 312 and the slope of the roof 104.

The lateral bracing system 320 in FIG. 11 includes a pair of buckling-restrained braced devices 324, one on each of the top and bottom flanges of beam 312. The pair of buckling-restrained braced devices 324 in FIG. 11 may be structurally and operationally identical to the pair of buckling-restrained braced devices 124 shown in FIGS. 3-5.

Referring now to FIG. 12, the column 310 includes a primary portion 310*a*, and a top portion 310*b* formed at a top of column 310 which may be similar to the embodiments described above. As in FIG. 11, in the embodiment of FIG. 12, the connecting face 322 of the top portion 310*b* is angled downward instead of upward. The angle of connecting face 322 in FIG. 12 is provided to be perpendicular to a major axis of beam 312 and the slope of the roof 104.

The lateral bracing system 320 in FIG. 12 includes a pair of buckling-restrained braced devices 324*a* and 324*b*, one on each of the top and bottom flanges of beam 312. The pair of buckling-restrained braced devices 324*a* and 324*b* in FIG. 12 may be structurally and operationally identical to the pair of buckling-restrained braced devices 224*a* and 224*b*, respectively, shown in FIGS. 7-9.

It is a feature of the above-described embodiments that the connecting face 122/222 of the column is perpendicular to a major axis of the beam 112 and a slope of the roof 104 when assembled. Thus, the angle of the connecting face 122/222 will vary depending on the slope of the roof and beams. Having the connecting face 122/222 perpendicular to an axial length of the beam ensures that the loads on the yield link 126/226*a*/226*b* will be tensile and compressive loads in the plane of the yield link.

Similarly, for the embodiment including flat plate yield link 226*b*, the top edge 229 of the column is also provided at an angle that matches a slope of the beam 212 and roof 104, and the top edge 229 is coplanar with a top surface of the top flange of the beam 212. Having the top edge 229 coplanar with the top flange of the beam ensures that the loads on the flat plate yield link 226*b* will be tensile and compressive loads in the plane of the yield link.

As used herein, a connection may be a direct connection or an indirect connection (e.g., via one or more other parts). In some cases, when an element is referred to as being affixed, connected or mounted to another element, the element may be directly connected to the other element or indirectly connected to the other element via intervening elements. When a first element is referred to as being directly affixed, directly connected or directly mounted to a second element, then there are no intervening elements between the first and second elements.

Although the invention has been described in detail herein, it should be understood that the invention is not limited to the embodiments herein disclosed. Various changes, substitutions and modifications may be made thereto by those skilled in the art without departing from the spirit or scope of the invention as described and defined by the appended claims.

What is claimed is:

1. A sloped roof construction, comprising:

a beam having first and second flanges and a major axis at a non-horizontal angle following a slope of the roof;

a vertical column comprising a connecting face configured to be oriented at an angle perpendicular to the major axis of the beam;

a shear tab affixed between the column and beam, between a top and bottom flange of the beam; and a lateral bracing system affixed between the column and beam, including:

first and second buckling-restrained braced devices, one each on the top and bottom flange of the beam, each buckling-restrained braced device comprising:

a yield link comprising a first end connected to the column and a second end connected to the beam, the yield link comprising a section of narrowed width defining first and second notches on opposite sides of the yield link, the yield link configured to yield in tension and compression at the narrowed width section to dissipate stress within the construction upon a lateral load applied to one or more of the beam and column;

first and second spacers fitting within the first and second notches, respectively; and a buckling restraint plate configured to mount over the yield link and spacers to sandwich the yield link and spacers between the buckling restraint plate and one of the top and bottom flanges of the beam.

2. The sloped roof construction of claim 1, wherein the shear tab comprises a central circular mounting hole and a plurality of oblong holes radially spaced away from the central circular mounting hole.

3. The sloped roof construction of claim 2, wherein a length of each of the plurality of oblong holes are oriented perpendicularly to radius from the central circular mounting hole.

4. The sloped roof construction of claim 1, wherein an end of the beam configured to be mounted adjacent the column comprises a central web between the first and second flanges, and wherein the first and second flanges are recessed relative to the web to define first and second notches at the top and bottom flanges of the beam at the end of the beam.

5. The sloped roof construction of claim 4, wherein the shear tab comprises a central circular mounting hole, a line between recessed ends of the first and second flanges at the end of the beam passes through the central circular mounting hole.

6. The sloped roof construction of claim 1, wherein the first end of the yield link in each of the first and second buckling-restrained braced devices comprises a perpendicular plate with a surface configured to mount parallel to and against the connecting face of the column.

7. The sloped roof construction of claim 6, wherein the perpendicular plate comprises a plurality of bolt holes configured to receive bolts to mount the perpendicular plate and yield link to the connecting face of the column.

8. The sloped roof construction of claim 6, wherein the second end of the yield link in each of the first and second buckling-restrained braced devices comprises a planar section with a surface configured to mount parallel to and against one of the first and second flanges of the beam.

9. The sloped roof construction of claim 8, wherein the planar section comprises a plurality of bolt holes configured to receive bolts to mount the planar section and yield link to one of the first and second flanges of the beam.

10. The sloped roof construction of claim 1, wherein the first end of the yield link in the first and second buckling-restrained braced devices comprises a first planar section with a surface configured to mount parallel to and against a top edge of the column adjacent the connecting face of the column.

11. The sloped roof construction of claim 10, wherein the first planar section comprises a first plurality of bolt holes configured to receive bolts to mount the first planar section and yield link to the top edge of the column.

12. The sloped roof construction of claim 10, wherein the second end of the yield link in each of the first and second buckling-restrained braced devices comprises a second planar section with a surface configured to mount parallel to and against one of the first and second flanges of the beam.

13. The sloped roof construction of claim 12, wherein the second planar section comprises a second plurality of bolt holes configured to receive bolts to mount the second planar section and yield link to one of the first and second flanges of the beam.

14. A sloped roof construction, comprising:

a vertical column comprising:

a top edge at a non-horizontal angle following a slope of the roof, and a connecting face adjacent the top edge;

a beam having a major axis at the non-horizontal angle, a first flange following the slope of the roof and a second flange;

a shear tab affixed between the column and beam, between a top and bottom flange of the beam; and a lateral bracing system affixed between the column and beam, including:

first and second buckling-restrained braced devices, one each on the top and bottom flange of the beam, the first buckling-restrained braced device comprising:

a first yield link comprising:

a first end comprising a first planar section with a first surface configured to mount parallel to and against the top edge of the column, a second end comprising a second planar section with a second surface configured to mount parallel to and against the first flange of the beam, and a section of narrowed width between the first and second ends, the narrowed width section defining first and second notches on opposite sides of the first yield link, the first yield link configured to yield in tension and compression at the narrowed width section to dissipate stress within the construction upon a lateral load applied to one or more of the beam and column;

first and second spacers fitting within the first and second notches, respectively; and a buckling restraint plate configured to mount over the first yield link and spacers to sandwich the first yield link and spacers between the buckling restraint plate and the first flange of the beam.

15. The sloped roof construction of claim 14, wherein the first end of the first yield link is bolted to the column and the second end of the first yield link is bolted to the beam.

16. The sloped roof construction of claim 14, wherein the second buckling-restrained braced device comprises a second yield link comprising:

a first end comprising a perpendicular plate configured to mount parallel to and against the connecting face of the column, a second end comprising a planar section with a surface configured to mount parallel to and against the second flange of the beam, and a section of narrowed width between the first and second ends, the narrowed width section defining first and second notches on opposite sides of the yield link, the yield link configured to yield in tension and compression at the narrowed width section to dissipate stress within the construction upon a lateral load applied to one or more of the beam and column.

17. The sloped roof construction of claim 16, wherein the connecting face is perpendicular to the major axis of the beam.

18. A sloped roof construction, comprising:

a vertical column comprising:

a top edge at a non-horizontal angle following a slope of the roof, and a connecting face adjacent the top edge, the connecting face provided at a non-vertical angle perpendicular to the slope of the roof;

a beam having first and second flanges and a major axis at the non-horizontal angle following the slope of the roof; and a lateral bracing system affixed between the column and beam, including:

first and second buckling-restrained braced devices, one each on a top flange and a bottom flange of the beam, the first buckling-restrained braced device comprising:

a first yield link comprising:

a first end comprising a first planar section with a first surface configured to mount parallel to and against the top edge of the column, a second end comprising a second planar section with a second surface configured to mount parallel to and against the first flange of the beam, and a first section of narrowed width between the first and second ends, the first narrowed width section defining first and second notches on opposite sides of the first yield link, the first yield link configured to yield in tension and compression at the first narrowed width section to dissipate stress within the construction upon a lateral load applied to one or more of the beam and column; and a first buckling restraint plate configured to mount over the first yield link to sandwich the first yield link between the buckling restraint plate and the first flange of the beam;

the second buckling-restrained braced device comprising:

a second yield link comprising:

a first end comprising a perpendicular plate configured to mount parallel to and against the connecting face of the column, a second end comprising a planar section with a surface configured to mount parallel to and against the second flange of the beam, and a second section of narrowed width between the first and second ends, the narrowed width section defining first and second notches on opposite sides of the yield link, the yield link configured to yield in tension and compression at the second narrowed width section to dissipate stress within the construction upon a lateral load applied to one or more of the beam and column; and a second buckling restraint plate configured to mount over the second yield link to sandwich the second yield link between the buckling restraint plate and the second flange of the beam.

19. The sloped roof construction of claim 18, further comprising a shear tab affixed between the column and beam, between the top and bottom flanges of the beam, the shear tab configured to define an axis of rotation of the beam relative to the column.

20. The sloped roof construction of claim 19, wherein an end of the beam configured to be mounted adjacent the column comprises a central web between the first and second flanges, and wherein the first and second flanges are recessed relative to the web to define first and second notches at the top and bottom flanges of the beam at the end of the beam, a line through the recessed ends of the first and second flanges passing through the axis of rotation of the beam relative to the column.

* * * * *